United States Patent [19]

Amano

[11] Patent Number: 4,516,053

[45] Date of Patent: May 7, 1985

[54] FLAT PANEL DISPLAY APPARATUS

[75] Inventor: Yoshifumi Amano, Kamakura, Japan

[73] Assignee: Sony Corporation, Tokyo, Japan

[21] Appl. No.: 335,586

[22] Filed: Dec. 29, 1981

[30] Foreign Application Priority Data

Jan. 13, 1981 [JP] Japan ..... 56-3441

[51] Int. Cl.[3] ..... H01J 17/49

[52] U.S. Cl. ..... 313/584

[58] Field of Search ..... 313/584; 315/586

[56] References Cited

U.S. PATENT DOCUMENTS 3,885,195 5/1975 Amano ..... 313/584 X 4,024,613 5/1977 Martel et al. ..... 313/584 X

FOREIGN PATENT DOCUMENTS 117678 9/1979 Japan ..... 313/584

*Primary Examiner*—Palmer Demeo

*Attorney, Agent, or Firm*—Hill, Van Santen, Steadman & Simpson

[57] ABSTRACT

A flat panel display apparatus is disclosed which includes first and second insulating plates at least one of which is transparent, a first plurality of parallel electrodes mounted on one surface of the first plate, a second plurality of parallel electrodes mounted on one surface of the second plate to intersect at a predetermined angle to the first electrodes, the first electrodes being spaced with and opposed to the second electrodes to define a cross conductor matrix for locating glowing regions, and a plurality of parallel insulating barriers mounted on at least one surface of the first plate so as to extend in parallel with the first electrodes and project toward the second plate, the barriers having the same pattern, pitch and width as that of the first electrodes, and each of the barriers overlapping the respective one side edge portion of one of the first electrodes, and the first and second plates being joined together with their outer edges sealed and gas capable of glowing mounted between the plates.

4 Claims, 9 Drawing Figures

FLAT PANEL DISPLAY APPARATUS

BACKGROUND OF THE INVENTION

1. Field of the Invention

The present invention relates generally to a discharge display apparatus of the flat panel type, and method of manufacturing of this apparatus, and is directed more particularly to a so-called DC type discharge matrix display apparatus in which a pair of anode electrodes and cathode electrodes of discharge electrodes are respectively made of parallel electrode groups arranged in row and column directions, both electrode groups oppose each other with a predetermined distance and the discharge glow at the opposing portion between the electrodes of both electrode groups serves to perform a glow display.

2. Description of the Prior Art

As shown in FIGS. 1 and 2, a prior art DC type discharge matrix display apparatus is formed of a flat envelope 1 which consists of two substrates 2 and 3, each being formed, for example, of a glass plate, with discharge electrodes, etc., disposed therein. In this case, one of the substrates 2 and 3, the substrate 2 in the illustrated example is made of a glass plate which is light permeable or transparent. Both substrates 2 and 3 face each other and their peripheral edge portions are sealed up by, for example, frit glass 4 to define a flat glow space 5 between the two substrates 2 and 3 in which the flat glow space 5 is sealed up by a rare gas.

On the inner surface of one substrate, for example, substrate 3, is coated an electrode group Y which serves as a cathode and is formed of a plurality of parallel electrodes $Y_1$, $Y_2$, $Y_3$, . . . , each arranged in one direction, for example, in a row direction with a predetermined distance between adjacent ones and having a necessary width. An insulating group of barriers G are also formed on the inner surface of the substrate 3 on which the electrode group Y are formed. The insulating group of barriers G are formed of a plurality of insulating projection barriers $g_1$, $g_2$, $g_3$, . . . with each arranged in the direction perpendicular to the extending direction of the respective electrodes $Y_1$, $Y_2$, $Y_3$, . . . of the cathode electrode group Y with a predetermined distance between adjacent ones and having a necessary width. In this case, the height of each of the projection barriers $g_1$, $g_2$, $g_3$ . . . is selected in response to the space between the substrates 2 and 3.

On the inner surface of the other substrate 2, are coated a group of anode electrodes X which consist of a plurality of parallel electrodes $x_1$, $x_2$, $x_3$ . . . , each being arranged in the direction substantially perpendicular to the extending direction of each of the parallel electrodes $Y_1$, $Y_2$, $Y_3$, . . . , forming the cathode electrode group Y and having a predetermined width.

In this case, the respective anode electrodes $x_1$, $x_2$, $x_3$, . . . , of the anode electrode group X are separated by the respective projection barriers $g_1$, $g_2$, $g_3$, . . . of the group of insulating projection barriers G to define band-shaped spaces 5*a*, 5*b*, 5*c*, . . . in the space 5 to prevent the diffusion of the glow from being extended along each of the cathode electrodes $Y_1$, $Y_2$, $Y_3$, . . . . When ON voltage is applied, for example, to the respective electrodes $Y_1$, $Y_2$, $Y_3$, . . . , of the cathode electrode group Y in a time-division multiplex manner while ON voltages in response to the display signals are applied to the respective electrodes $x_1$, $x_2$, $x_3$, . . . of the anode electrode group X sequentially or simultaneously, glow or light emissions with brightnesses in response to the voltage differences according to the display signals are effected to produce a light picture image in dot-sequence or line-sequence to thereby produce a display.

In general, with the above kind of a display apparatus, the respective electrodes $x_1$, $x_2$, $x_3$, . . . of the anode electrode group X are located substantially at the center of the respective discharge or glow spaces 5*a*, 5*b*, 5*c*, . . . and the light emission or glow is observed from the anode electrode side. In this case, if the respective electrodes $x_1$, $x_2$, $x_3$ . . . of the anode electrode group X are each made of a transparent electrode, a bright display can be realized. However, since such a transparent electrode has a high electrical resistance, if the anode electrode is made of such transparent electrode, it does not produce a preferred uniform brightness. Therefore, in this kind of the display apparatus, the electrodes at the observing side are generally made of opaque electrodes which have less electrical resistance. Normally, the arranging pitch of the light emission or glow portions or discharge spaces 5*a*, 5*b*, 5*c*, . . . is selected to be about 200 μm. In this case, the respective electrodes $x_1$, $x_2$, $x_3$, . . . of the anode electrode group X at the observing side and the respective barriers $g_1$, $g_2$, $g_3$, . . . are generally formed by a printing method, so that the width of the anode electrodes is 70 μm. However, since the height of the respective barriers $g_1$, $g_2$, $g_3$, . . . must be rather high, for example, 100 to 150 μm, the printing method is repeated several times with the result that the width of each of the barriers $g_1$, $g_2$, $g_3$, . . . becomes about 100 μm. Accordingly, in this case, the width of each of the spaces 5*a*, 5*b*, 5*c*, . . . becomes about 100 μm, but a 70 μm portion thereof is shielded by each of the anode electrodes $x_1$, $x_2$, $x_3$, . . . so that the width of light emission or glow display capable of being observed is only 15 μm on each sides of each of the anode electrodes $x_1$, $x_2$, $x_3$, . . . or 70% of the width of the discharge light emission or glow portion is shielded by the anode electrodes $x_1$, $x_2$, $x_3$, . . . .

OBJECTS AND SUMMARY OF THE INVENTION

Accordingly, an object of the present invention is to provide a novel flat panel discharge display apparatus free from the defects inherent to the prior art.

Another object of the invention is to provide a flat panel discharge display apparatus which can produce a brilliant display by a specific construction.

According to an aspect of this invention, there is provided a flat panel display apparatus, which comprises first and second insulating plates with at least one of said plates being transparent; a first plurality of parallel electrodes mounted on one side of said first plate; a second plurality of parallel electrodes mounted on one side of said second plate at a predetermined angle to said first electrodes; said first electrodes being spaced with and opposed to said second electrodes to define a cross conductor matrix for locating glowing regions; a plurality of parallel insulating barriers mounted on at least said one side of said first plate so as to extend parallel with said first electrodes and project toward said second plate, said barriers having the same pattern in pitch and width as said first electrodes, one of said barriers overlapping the respective one side edge portions of one of said first electrodes, and said first and second plates being joined together with their outer edges sealed and gas capable of glowing mounted between said plates.

Other objects, features and advantages of the present invention will become apparent from the following description taken in conjunction with the accompanying drawings through which the like references designate the same elements and parts.

DESCRIPTION OF THE PREFERRED EMBODIMENT

The present invention will be hereinbelow described with reference to the attached drawings.

This invention is based on the fact that according to the prior art the width of the anode electrode on the viewing or observing side for the light emission or glow display comes up to about 70 μm in this kind of discharge display apparatus due to the problem of manufacturing the same as set forth above, but it be sufficient that the width of the anode electrode is about 20 μm for performing the function as the discharged electrode.

Figure 1:
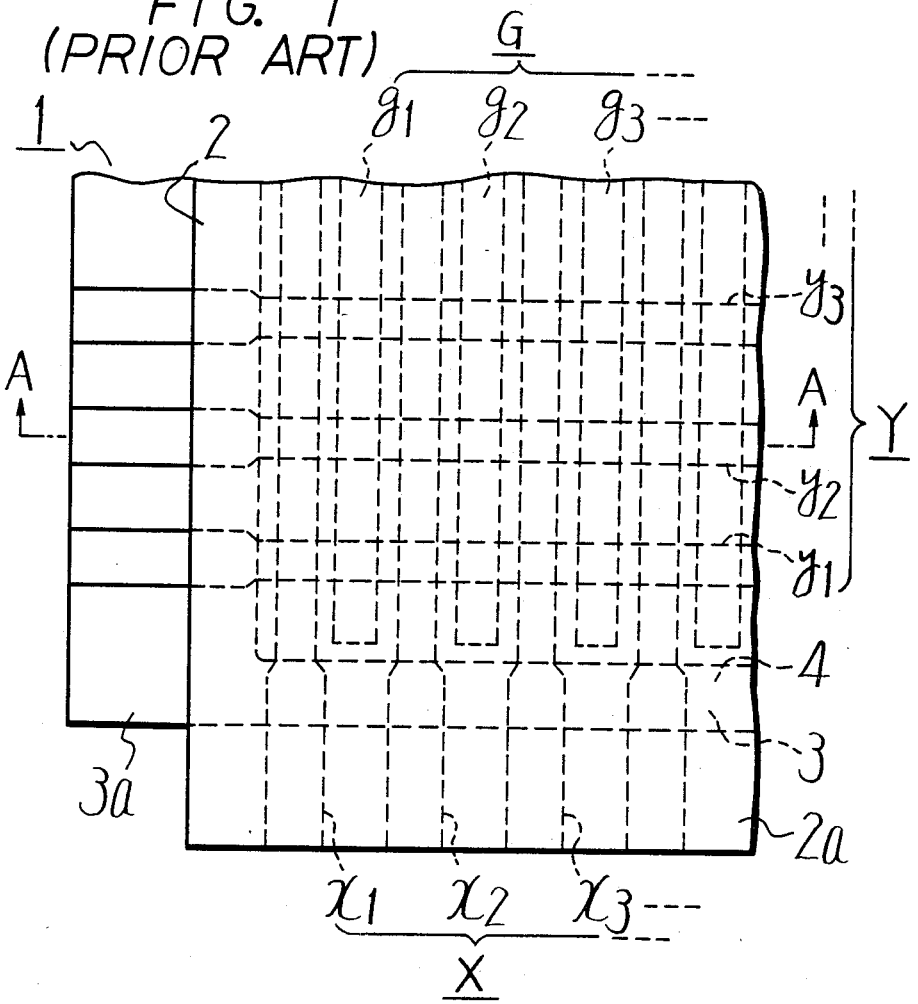
FIG. 1 (PRIOR ART)
FIG. 1 is a plan view showing the essential part of a prior art discharge display apparatus.
Figure 2:
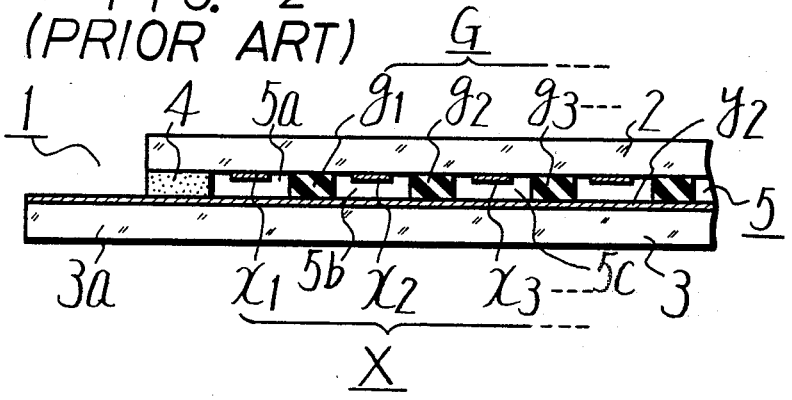
FIG. 2 (PRIOR ART)
FIG. 2 is a cross-sectional view taken along the line A—A in FIG. 1.
Figure 3:
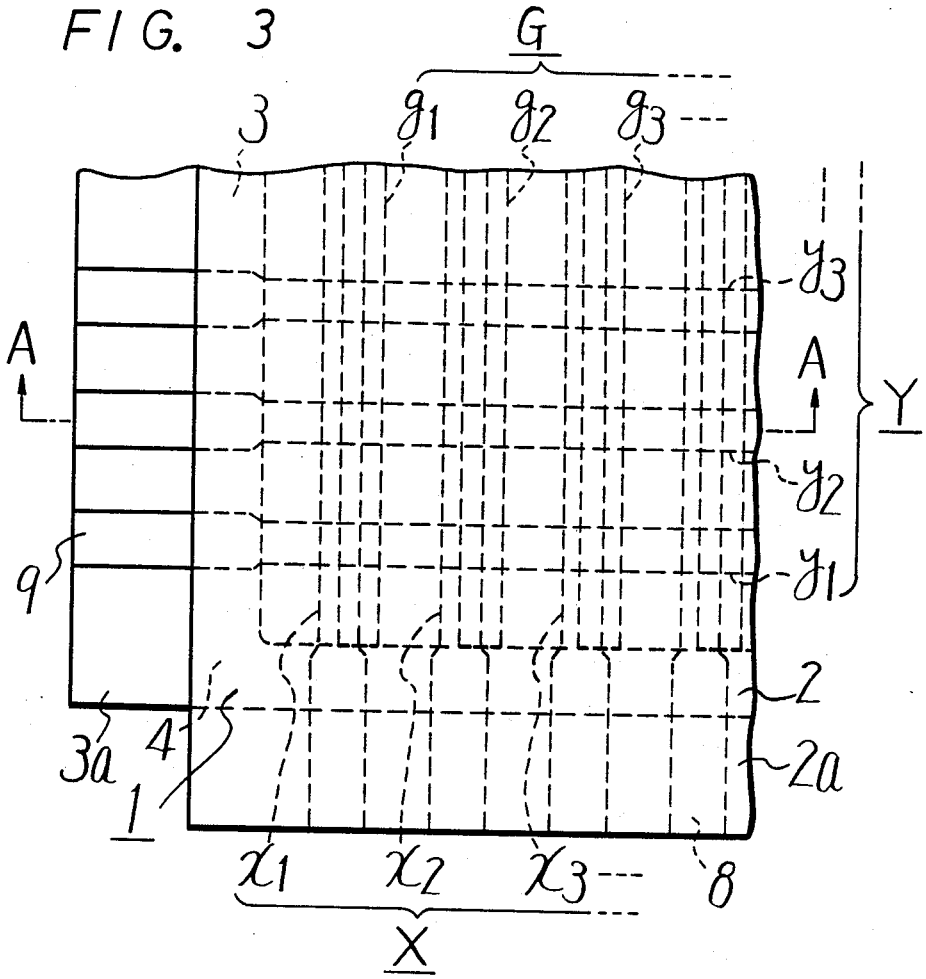
FIG. 3 is a plan view showing the essential part of an example of the flat panel discharge display apparatus according to the present invention.
Figure 4:
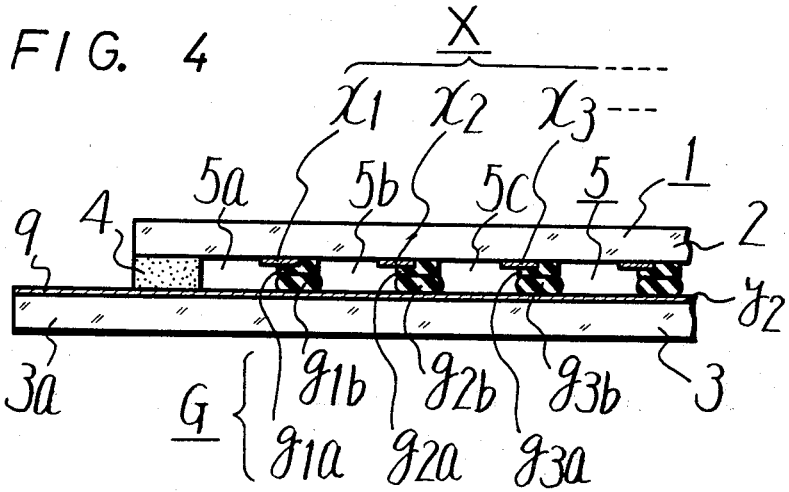
FIG. 4 is a cross-sectional view taken on the line A—A in FIG. 3.

An example of the discharge display apparatus according to this invention will be now described with reference to FIGS. 3 and 4 in which the parts corresponding to those of FIGS. 1 and 2 are marked with the same references and their description will be omitted. As shown in the figures, according to the invention, the opposing substrates 2 and 3 are also provided, and on the inner or opposing surfaces thereof, there are respectively provided the anode electrode group X, which consists of parallel electrodes $x_1$, $x_2$, $x_3$, . . . made by the printing method, and the cathode electrode group Y, which consists of a plurality of parallel electrodes $Y_1$, $Y_2$, $Y_3$, . . . made by the printing method and extend in the direction to intersect the anodes at an angle, for example, substantially perpendicular to the anodes. In this invention, similar to the prior art, there is provided the group of insulating barriers G between the substrates 2 and 3 to define the band-shaped glow spaces 5*a*, 5*b*, 5*c*, . . . relating to the respective anode electrodes $x_1$, $x_2$, $x_3$, . . . in the glow space 5. In this group of invention, especially, this insulating barriers G is formed of first and second groups of insulating projection stripe barriers $g_{1a}$, $g_{2a}$, $g_{3a}$, . . . and $g_{1b}$, $g_{2b}$, $g_{3b}$, . . . which which abut at their top surfaces with each other at least partially in their width direction with no discontinuity in their extending direction to thereby define the glow spaces 5*a*, 5*b*, 5*c*, . . . .

With this invention, the pattern of the respective anode electrodes $x_1$, $x_2$, $x_3$, . . . of the anode electrode group X is made to be the same as that of the first group of insulating barrier stripes $g_{1a}$, $g_{2a}$, $g_{3a}$, . . . and further the anode electrodes $x_1$, $x_2$, $x_3$ . . . of the anode electrode group X are respectively located near one side or the right side of the respective glow spaces 5*a*, 5*b*, 5*c*, . . . in the illustrated example. In this case, each of the first insulating barrier stripes $g_{1a}$, $g_{2a}$, $g_{3a}$, . . . is so coated that it covers one side edge (the right side edge in the illustrated example) each of the corresponding anode electrodes $x_1$, $x_2$, $x_3$, . . . over a predetermined width, for example, about 40 μm in the case where the width of the respective anode electrodes $x_1$, $x_2$, $x_3$, . . . is 70 μm. Thus, the respective anode electrodes $x_1$, $x_2$, $x_3$, . . . face the respective glow spaces 5*a*, 5*b*, 5*c*, . . . with the width of remaining portion of about 30 μm.

Although the respective electrode groups X and Y and the barrier group G on the substrates 2 and 3 are respectively formed by the screen printing method with a, so called lift-off by a mask or the like with predetermined patterns, since according to the present invention the anode electrodes $x_1$, $x_2$, $x_3$, . . . and the first barrier stripes $g_{1a}$, $g_{2a}$, $g_{3a}$, . . . which are formed on the same substrate 2 are formed to have the same pattern, and during forming they are made by the same method with the same mask. In this case, the same mask is moved by a predetermined distance during the manufacturing process of both anode electrodes $x_1$, $x_2$, $x_3$, . . . and barrier stripes $g_{1a}$, $g_{2a}$, $g_{3a}$, . . . to make them with accurate positional relation to the predetermined pattern.

Now a, description will be given for the case where the anode electrodes $x_1$, $x_2$, $x_3$, . . . and the first barrier stripes $g_{1a}$, $g_{2a}$, $g_{3a}$, . . . are made by the screen printing method. In this case, on the substrate 2 screen-printed at first there are printed anode electrodes $x_1$, $x_2$, $x_3$, . . . which comprise the anode electrode group X with the aforesaid parallel pattern, in which Ni paste, by way of example #9530 (Trade Name) made by the Dupont Co., Ltd., is used as the conductive paste. After printing, a drying process is carried out to evaporate the solvent in the conductive paste of the printing pattern and then the first group of barrier stripes $g_{1a}$, $g_{2a}$, $g_{3a}$, . . . are screen-printed. This latter screen printing is carried out by the screen printing machine which is also employed to perform the screen printing of the anode electrodes $x_1$, $x_2$, $x_3$, . . . and it uses the same mask. In this case, however, the mask is moved in the width direction of its parallel pattern by a predetermined distance, for example, 30 μm while parallel relation is maintained, and instead of the former conductive paste, glass paste, for example, NT-100 (Trade Name) made by the Nippon Toki Ltd., is employed as the printing ink to make the first barrier stripes $g_{1a}$, $g_{2a}$, $g_{3a}$, . . . of the parallel pattern. Thereafter, they are subjected to a thermal process at, for example, 540° C. and for 60 minutes for the electrodes $x_1$, $x_2$, $x_3$, . . . and barrier stripes $g_{1a}$, $g_{2a}$, $g_{3a}$, . . . In this way, the electrodes $x_1$, $x_2$, $x_3$, . . . and barrier stripes $g_{1a}$, $g_{2a}$, $g_{3a}$, . . . , which have the same parallel pattern, but are merely displaced in position, are provided.

Figure 5:
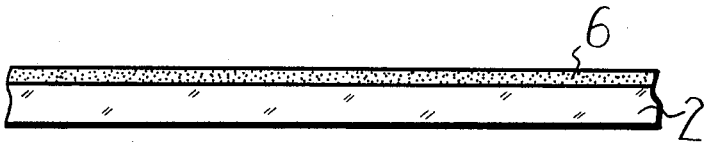
FIGS. 5 to 9 are respectively cross-sectional views used to explain one process of making this invention.
Figure 6:
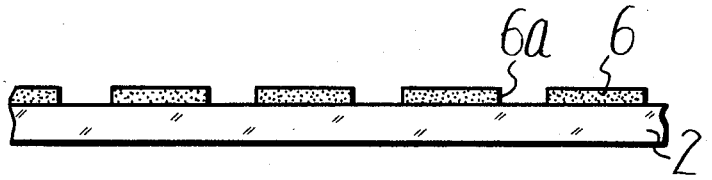
Figure 7:
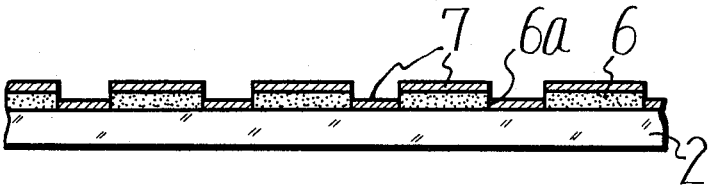
Figure 8:
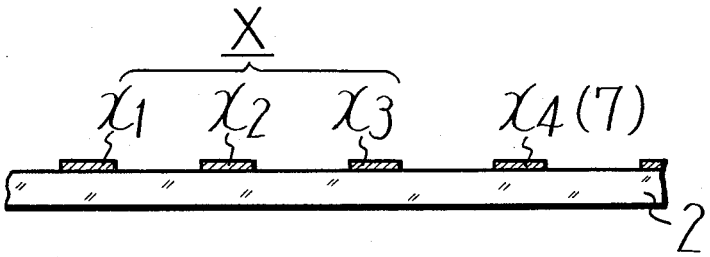
Figure 9:
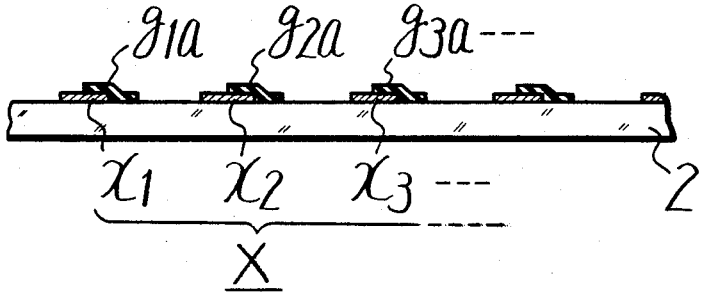

The above example is for the case where the screen printing method is employed to provide the patterns, but in this invention other various pattern forming methods can be employed. For example, a description will be made for the case where the lift-off method by a mask is employed with reference to FIGS. 5 to 9. At first, as shown in FIG. 5, a photo-sensitive resin layer 6 is coated on the substrate 2. This photo-sensitive layer 6 can be formed by coating, for example, polyvinyl alcohol having the photo-sensitivity on the substrate 2, but in this case a Liston film (Trade Name), made by the Dupont Co., Ltd., by way of example, may be used to prepare the photo-sensitive layer 6. This photo-sensitive layer 6 is subjected to exposing and to a developing processes to remove the corresponding pattern of the anode electrodes $x_1$, $x_2$, $x_3$, . . . to be finally obtained and to thereby provide renamed portions 6*a* which serve as a mask of a pattern for lift-off as shown in FIG. 6. Next, as shown in FIG. 7, a conductive layer 7 is coated on the mask made of the resin layer 6 also covering the renamed portions 6*a* by the screen printing method using, for example, Ni-paste. Thereafter, the mask made of the photo-sensitive resin layer 6 is removed. This removal of the mask is carried in a manner such that if the mask is made of the Liston film, it is heated at 400° C. to 500° C. to and will be dispersed away. Thus, in this manner, the mask or resin layer 6 is removed so that the portion of the conductive layer 7 printed on the resin layer 6 is removed or lifted off. Thus, as shown in FIG. 8, only the conductive layer 7 directly printed or coated on the substrate 2 remains to provide the anode electrode group x consisting of anode electrodes $x_1$, $x_2$, $x_3$, . . . . Thereafter, though not shown, a photo-sensitive resin layer similar to that mentioned above is coated all over the substrate 2 including the electrode group X and then subjected to similar exposing and developing processes to form a pattern. In this case, the exposing mask is the same as that used during the exposing process of the resin layer 6, and is used for the exposing process of the latter resin layer but is moved in a parallel direction by a predetermined width. The pattern of the resin layer thus made has a pattern which is the same as that of the taken-away portions 6*a* shown in FIG. 6, but is different or is moved with a parallel relationship to the former. Therefore, if the glass plate is then printed on all of the surfaces thereof, the resin layer is removed, the printed layer thereon is lifted off and then sintered and, the first barrier stripes $g_{1a}$, $g_{2a}$, $g_{3a}$, . . . are formed on the anode electrodes $x_1$, $x_2$, $x_3$, . . . which are shifted from the latter by a predetermined width as shown in FIG. 9.

As described above, since the anode electrodes $x_1$, $x_2$, $x_3$, . . . and the barrier stripes $g_{1a}$, $g_{2a}$, $g_{3a}$, . . . coated on the same substrate 2 are formed by the same method with the same mask, they can be provided with accurate positional relation. When the first barrier stripes $g_{1a}$, $g_{2a}$, $g_{3a}$, . . . are formed, in order to obtain a predetermined height thereof, the printing method may be repeated several times while using the same mask.

On the other hand, on the other substrate 3, there is formed the cathode electrode group Y similar to those formed on substrate 2. For example, it is formed by the screen printing method using the Ni-paste, drying and then glass paste is printed thereon by the screen printing method using the mask which has the parallel pattern which intersects the other pattern, for example, the pattern which is substantially the same as that of the former mask to form the second barrier stripes $g_{1b}$, $g_{2b}$, $g_{3b}$, . . . . For these barrier stripes $g_{1b}$, $g_{2b}$, $g_{3b}$, . . . , the printing process is repeated, for example, eight times to make their heigths larger. Thereafter, they are subjected to the sintering process similar to that mentioned previously. When each of the first barrier stripes $g_{1a}$, $g_{2a}$, $g_{3a}$, . . . has a sufficient height, it is not necessary to make each of the second barrier stripes $g_{1b}$, $g_{2b}$, $g_{3b}$, . . . high. Further, it may be possible to omit the second barrier stripes $g_{1b}$, $g_{2b}$, $g_{3b}$, . . . For providing the cathode electrodes $Y_1$, $Y_2$, $Y_3$, . . . and the second barrier stripes $g_{1b}$, $g_{2b}$, $g_{3b}$, . . . , the aforementioned lift-off method may be employed.

At one end of each of the electrodes $x_1$, $x_2$, $x_3$, . . . and $Y_1$, $Y_2$, $Y_3$, . . . of the electrode groups X and Y, there are provided terminal portions 8 and 9 which respectively extend to the side edge portions 2*a* and 3*a* of the substrates 2 and 3, each being extended from the opposing portion thereof so they will be outside the sealed up space between the substrates 2 and 3.

The above-described flat panel discharge display apparatus according to this invention can be driven by a driving method similar to that for driving the prior art discharge display apparatus described in connection with FIGS. 1 and 2 to perform its glow display which is viewed or observed from the side on which the anode electrodes $x_1$, $x_2$, $x_3$, . . . are coated. In this case, also with the discharge display apparatus of this invention, the light emission or glow display takes place in each of the glow spaces 5*a*, 5*b*, 5*c*, . . . at each of the opposing and intersecting portions of the electrodes $x_1$, $x_2$, $x_3$, . . . and $Y_1$, $Y_2$, $Y_3$, . . . . Especially, according to the present invention, since each of the anode electrodes $x_1$, $x_2$, $x_3$, . . . are displaced in each of the glow spaces 5*a*, 5*b*, 5*c*, . . . to one side thereof and a part of each of the electrodes $x_1$, $x_2$, $x_3$, . . . are displaced in their width direction, for example, its part having a width of 30 μm faces each of the glow spaces 5*a*, 5*b*, 5*c*, . . . , and the ratio of the glow display shielded by each of the electrodes $x_1$, $x_2$, $x_3$, . . . becomes lower than that of the prior art apparatus by less than ½ and the display by this invention becomes brilliant.

Further, according to this invention, it becomes unnecessary to use a transparent conductive layer, which is high in resistance, for each of the anode electrodes $x_1$, $x_2$, $x_3$, . . . but a metal conductive layer of high conductivity can be used as the anode electrodes, so that the discharge display apparatus becomes superior in reliability.

Furthermore, according to this invention, since the anode electrodes $x_1$, $x_2$, $x_3$, . . . and the barrier stripes $g_{1a}$, $g_{2a}$, $g_{3a}$, . . . are formed with the same pattern, the positional relation therebetween can be established accurately with the result that the display discharge apparatus can be mass-produced which has a uniform discharge display property with no scattering throughout the respective discharge display portions.

Furthermore, if the width of each of the electrodes $x_1$, $x_2$, $x_3$, . . . which face each of the glow spaces 5*a*, 5*b*, 5*c*, . . . is wider than 20 μm, their electrodes positively function as anode electrodes for discharging glow.

The above description is given on a single preferred embodiment of the invention, but it will be apparent that many modifications and variations could be effected by one skilled in the art without departing from the spirit or scope of the novel concepts of the invention, so that the scope of the invention should be determined by the appended claims only.

I claim as my invention:

1. A flat panel display apparatus comprising:

first and second insulating plates with at least one of said plates being transparent;

a first plurality of parallel electrodes mounted on one side of said first plate;

a second plurality of parallel electrodes mounted on one side of said second plate and at a predetermined angle other than zero to said first electrodes;

said first electrodes being spaced from and opposed to said second electrodes to define a cross conductor matrix for locating glowing regions;

a plurality of parallel insulating barriers mounted on at least said one side of said first plate and extending parallel with said first electrodes and projecting toward said second plate, said barriers having the same pattern, pitch and width as said first electrodes;

and a portion of each of said barriers overlapping a respective one side edge portion of one of said first electrodes; and said first and second plates joined together with their outer edges sealed and gas capable of glowing filled between said plates.

2. An apparatus according to claim 1, in which said insulating barriers comprise a first plurality of parallel insulating barriers mounted on said one side of said first plate and a second plurality of parallel insulating barriers mounted on said one side of said second plate so as to cross over and intersect said first electrodes, said first barriers abutting the corresponding ones of said second barriers at their respective top surfaces.

3. An apparatus according to claim 1, in which said first and second electrodes are anode electrodes and cathode electrodes, respectively.

4. An apparatus according to claim 1, in which the height of said barriers is substantially equal to the space between said first and second plates.

* * * * *